US005133556A

United States Patent [19]

Karasavas

[11] Patent Number: 5,133,556

[45] Date of Patent: Jul. 28, 1992

[54] GOLF TRAINER

[76] Inventor: Peter Karasavas, 45 Vernon Avenue, Eastlakes, New South Wales, 2018, Australia

[21] Appl. No.: 667,496

[22] Filed: Mar. 11, 1991

[30] Foreign Application Priority Data

Mar. 12, 1990 [AU] Australia ..... PJ9062

[51] Int. Cl.[5] ..... A63B 69/36

[52] U.S. Cl. ..... 273/183 C; 273/183 E; 273/187 R; 40/327; 33/508

[58] Field of Search ..... 273/213, 183 C, 183 E, 273/187 R, 187 A, 32 H; 33/508; 40/327

[56] References Cited

U.S. PATENT DOCUMENTS 4,441,716 4/1984 Chen ..... 273/183 C

FOREIGN PATENT DOCUMENTS 11171 of 1903 United Kingdom ..... 273/213

904785 8/1962 United Kingdom ..... 273/183 C

*Primary Examiner*—George J. Marlo

*Attorney, Agent, or Firm*—Felfe & Lynch

[57] ABSTRACT

An orientation apparatus includes a device including a semi-spherical cap adapted for placement on a golf ball. The device defines a reference plane and has a window permitting meridional markings on the golf ball or the device to be viewed and to be aligned relative to the reference plane. The device is provided with a spirit level and a directional indicator for alignment of the markings with an intended direction of play.

10 Claims, 7 Drawing Sheets

GOLF TRAINER

FIELD OF THE INVENTION

The present invention relates to an apparatus and method for training golf players in the preferred playing of the game.

BACKGROUND OF THE INVENTION

The object of golf is to hit a golf number of holes in the fewest number of strokes. However, proper hitting of the ball is often frustrated by player posture and movement and intentional hazards such as bunkers and ditches, the latter designed to provide varying conditions for the player.

For each stroke the player selects one from a set of golf clubs with which to hit the ball. The clubs of a set differ one from the other in significant respects including length of shaft and angle of the hitting face to the club shaft ("loft"). In preparation for hitting a ball, a player addresses the ball by adopting a stance in which (1) an imaginary line across the toes is substantially aligned with an intended direction of travel of the ball (2) the feet are spaced from the ball by a distance which varies according to the club of the set selected for use (3) the feet are moved in relation to a line through the ball and perpendicular to the intended direction of travel by an amount depending on the club selected for use, and (4) the head is in a correct position for a golf swing.

One of the common problems of playing golf is that it is very difficult to combine all of the elements required by the player to hit the ball with a selected golf club at a desired spot and angle. Many players have particular difficulty in adopting a correct address position with a given club in relation to a ball and intended direction of play. The difficulty is aggravated on sloping terrain.

During the down swing of the club a player's head desirably remains in a substantially stationary position in relation to the ball. Movement of the head may thus be symptomatic of an incorrect swing.

Hitherto, the only way to view and assess mistakes made by the player was to make a video tape of the stroke or have a professional or experienced teacher along to watch and correct mistakes. However, such methods are not only time consuming but also expensive and often impractical.

An object of the present invention is to furnish means which assist a player to learn or improve golfing ability and/or to assist a player in self-diagnosis of errors.

SUMMARY OF THE INVENTION

According to one aspect the invention consists in a golf ball having markings on its surface which are visible to a player addressing the ball, the markings defining a plurality of lines each extending in a meridonal direction, the lines being spaced apart in the equitorial direction. In a preferred embodiment of the ball, each meridonal line defines a plane at an angle from a reference plane, which provides a line-of-sight bearing for a player using a selected club from a set in relation to which to adjust his stance.

Desirably the markings are lines of a colour each different from another. The meridonal lines are preferably selected to be spaced at angles of between 13.3° to 25.6° from a reference line.

Preferred embodiments of the invention give the player an improved sense of his position in relation to the ball and direction of play. Desirably the markings also give the player a visual indication of head movement during swing and assists in diagnosis or cure of various other faults as will be hereinafter described.

According to a second aspect the invention consists in apparatus adapted to facilitate orientation of a golf ball according to the first aspect so that one of the meridonal lines is in a reference plane, for example a vertical plane, and desirably so that the meridonal line is aligned with an intended direction of play.

The orientation apparatus consists in a device adapted for placement on a golf ball and having a window permitting markings on the ball to be viewed whereby markings on the ball may be aligned relative to a vertical (or horizontal) plane. Preferably the device is supported on the ball by a cap which fits neatly on the ball and permits the ball to be reoriented by rotation while the device is held stationary. Desirably also the device is provided with a directional indicator for alignment of a meridian line on the ball with an intended direction of play. In preferred embodiments the device incorporates a spirit level.

According to a third aspect the invention consists in a method for training a player for playing the game of golf comprising the steps of:

placing a ball according to the first aspect in a predetermined orientation with respect to a vertical or horizontal reference plane, and placing the player so that when the player addresses the ball with a selected one from a set of clubs, a marked location on the oriented ball associated with the selected club is in substantial alignment between the player's eye and the centre of the ball.

For preference the ball is placed in the predetermined orientation by means of a device according to the second aspect of the invention.

For ease of description it is convenient to regard an imaginary line through the centre of the ball as defining a North and South pole on the surface of the ball and to define other locations on the surface by use of geographical terms.

PREFERRED EMBODIMENTS OF THE INVENTION

By way of example only, preferred embodiments of the invention will be described with reference to the accompanying drawings wherein.

Figure 13:
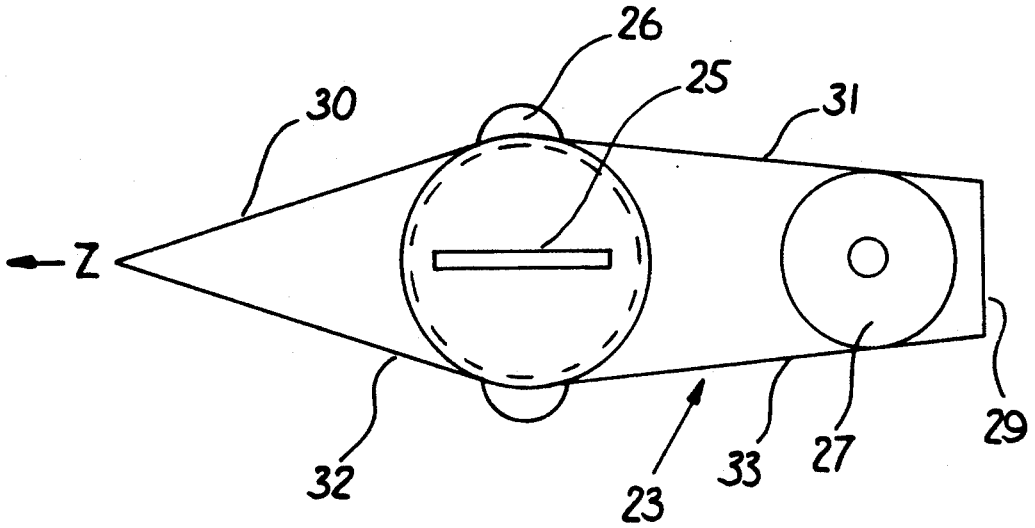
FIG. 13 shows a plan view of orientation apparatus according to the invention with a golf ball shown in broken lines.
Figure 13A:
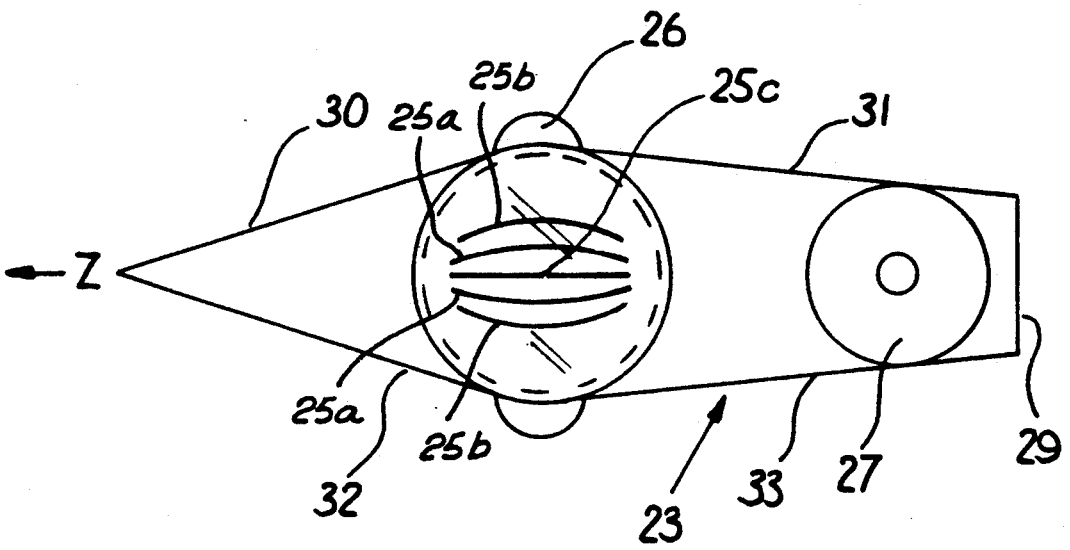

FIG. 13*a* is a plan view of orientation apparatus according to the invention in which the transparent window has meridional lines 25*a*, 25*b*, 25*c* and the golf ball is represented in broken line.

Figure 14:
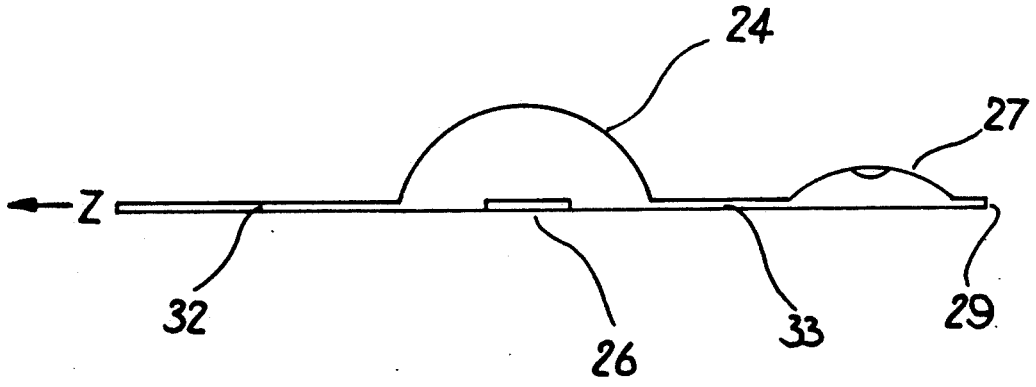

FIG. 14 shows a mid section elevation of the apparatus of FIG. 13.

Figure 14A:
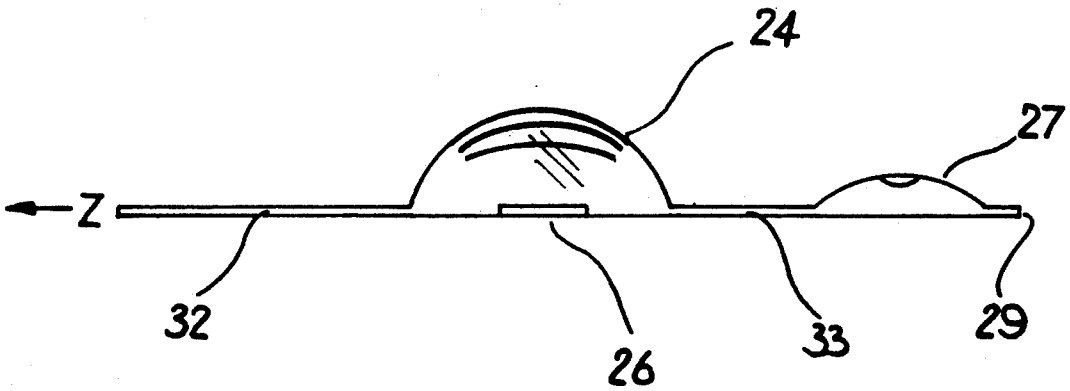
Figure 15:
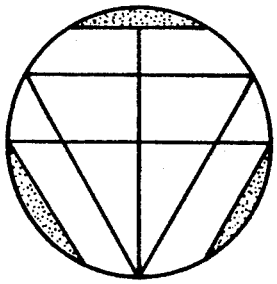
Figure 16:
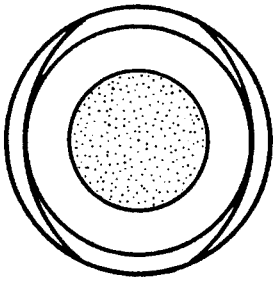
Figure 17:
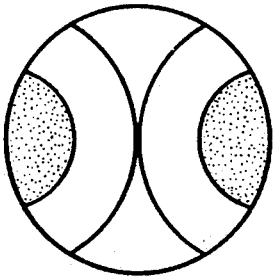
Figure 18:
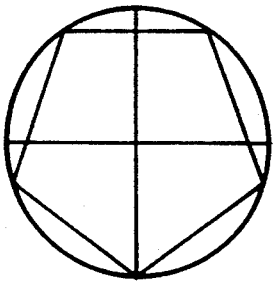
Figure 19:
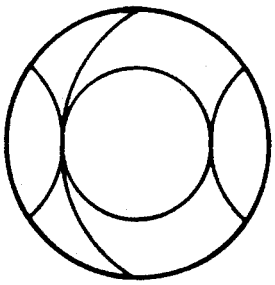
Figure 20:
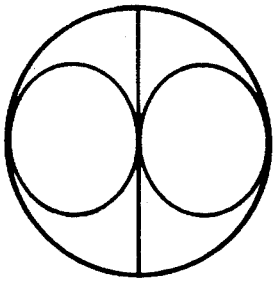

FIG. 14*a* is a midsection elevation of the apparatus of FIG. 13*a*.

FIGS. 15 to 20 each show schematically a respective further embodiment of a ball according to the invention.

Figure 1:
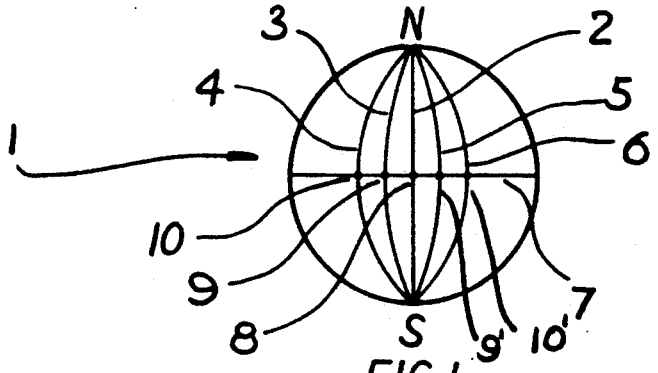
FIG. 1 is a schematic diagram of a first embodiment of a golf ball according to the invention when viewed in plan.

With reference to FIG. 1 there is shown schematically a first embodiment of a spherical golf ball in plan view.

The ball 1 has a notional North Pole indicated at 'N' and a South pole indicated at 'S'. A plurality of meridonal lines 2, 3, 4 are marked on the surface of the ball by being printed or inscribed thereupon, each line extending from the North pole to the South pole. Preferably each of meridonal lines 2, 3, 4 is in a colour which differs from that of each other.

Figure 2:
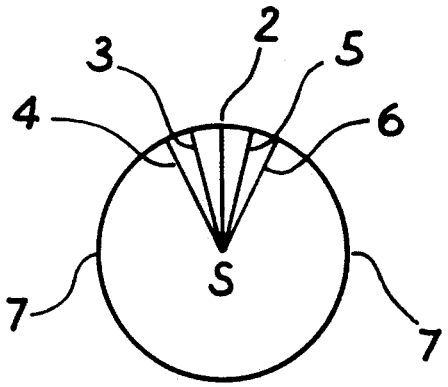
FIG. 2 is an end elevation of the ball of FIG. 1 viewed in elevation towards the South pole.

In the orientation in which the ball is shown in FIG. 2, meridonal line 2 lies in a vertical plane extending through the centre of the ball. Meridonal lines 5, 6 are symmetrically disposed on the opposite side of the plane in which meridian line 2 lies from lines 3, 4.

An equitorial line 7 is marked on the ball and visible in FIG. 1. It lies on the circumference of the ball as viewed in FIG. 2.

The intersection of equatorial line 7 and meridonal lines 2, 3, 4 defines locations 8, 9, 10 on the surface of the ball. Regarding line 2 as defining a 0° meridian then points 9 and 10 are respectively at 13.3° and 25.6° West and points 9' and 10' are at 13.3° and 25.6° East.

Figure 3:
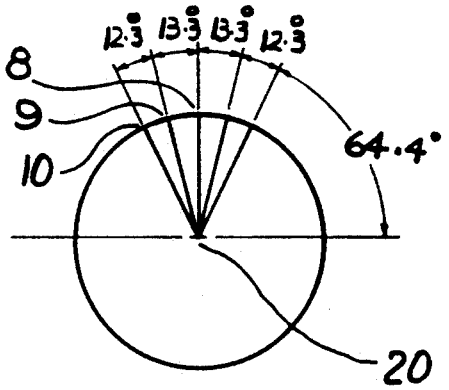
FIG. 3 is a section on a vertical mid-plane through the ball as viewed in FIG. 2 showing the angular relationship of points of intersection of the meridian lines and the equitorial line.

As is more clearly shown with reference to FIG. 3, notional rays extending from the centre 20 of the ball through points 9 and 10 make angles of 13.3° and 25.6° respectively with a vertical ray from the centre 20 through point 8 and define bearings with respect to the ball.

Figure 4:
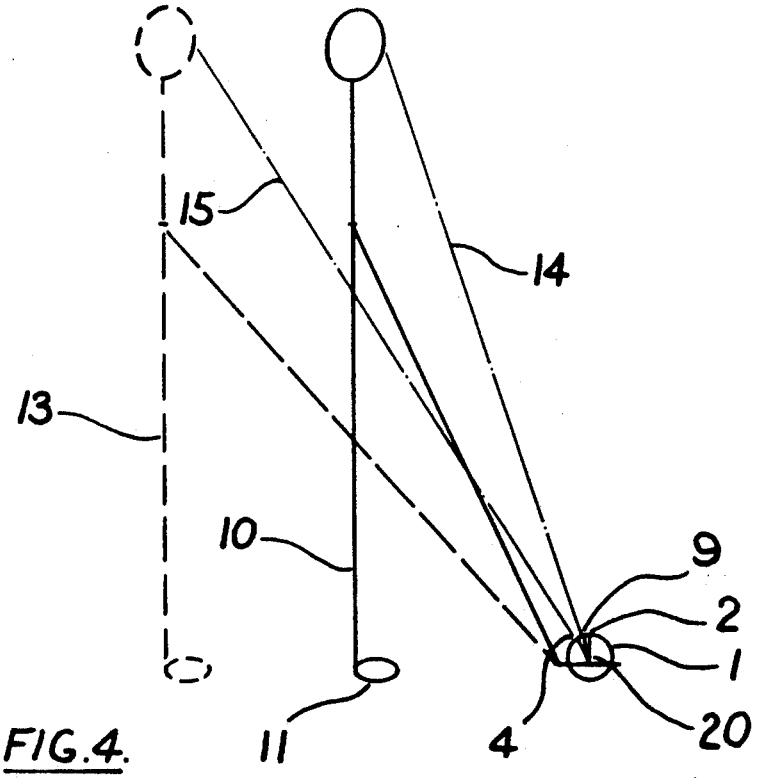
FIG. 4 shows schematically the relationship between a ball according to FIGS. 1–3 and a player in a first address position (and in broken lines a second address position).

FIG. 4 shows schematically and not to scale a golfer 10 having feet 11 in a first address position in relation to a ball 1 according to FIG. 1.

The first address position is appropriate for use with a sandwedge club. When the golf ball is orientated with meridonal line 2 in the vertical plane and aligned with an intended direction of play then the player sees meridian 9 as on sight line 14 towards the centre 20 of the ball.

Shown in broken lines in FIG. 4 is a golfer 13 in a second address Position appropriate for use with say a driver club. In this case, with the ball in the same position and orientation as previously (with meridian 2 lying in a vertical plane and aligned with the direction of play) player 13 sees meridian 4 on a sight line 15 towards the centre 20 of the ball. If the player's head is in an incorrect position the location on the meridian does not appear to the player to be aligned with the centre of the ball.

The same result can be achieved by rotating the ball (anti-clockwise with reference to FIG. 3) about its polar axis so that line 5 ("Wedge line") is brought into the vertical plane. Meridian 2 ("Putter line") is then used as the sight line for the first address position of FIG. 4 the ball being further rotated counter-clockwise until line 6 ("Driver line") is in the vertical plane to bring line 2 ("Putter line") onto the desired sight line for the second address position. The ball thus provides a line of sight bearing for a player using either of these clubs or, by interpolation, a club of intermediate loft.

With reference to FIGS. 5, 6, 7 and 8 there is shown a golf ball according to a second embodiment of the invention.

Figure 5:
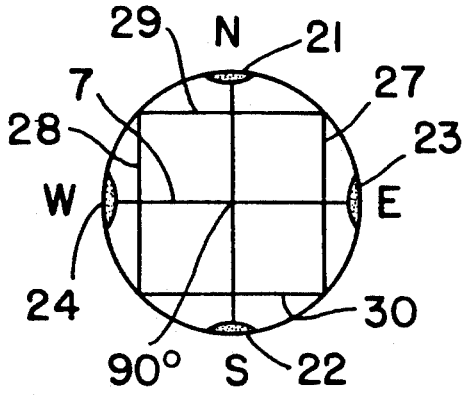
FIG. 5 shows a second embodiment of a ball according to the invention in plan viewed in an equitorial direction at 0°.
Figure 6:
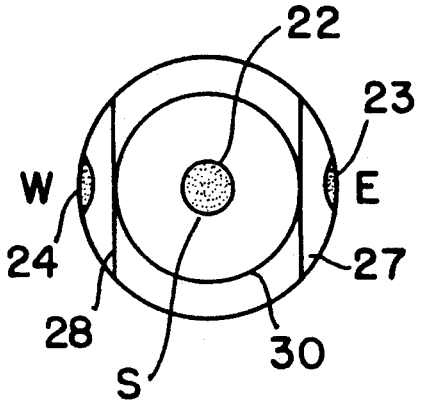
FIG. 6 shows the embodiment of FIG. 5 in elevation viewed in a polar direction.

In this embodiment the ball is marked with a solid circular marking 21, 22 extending over North and South Polar regions of the ball respectively and has similar circular markings 23, 24 centred on positions on the equator, on opposite sides of the ball at the 90° East and 90° West side when the ball is viewed from 0° as in FIG. 5.

Additionally the ball is marked with circular markings 27, 28 disposed concentrically with circles 23, 24 respectively and with circular markings 29, 30 disposed concentrically around polar circles 21, 22 respectively.

Figure 7:
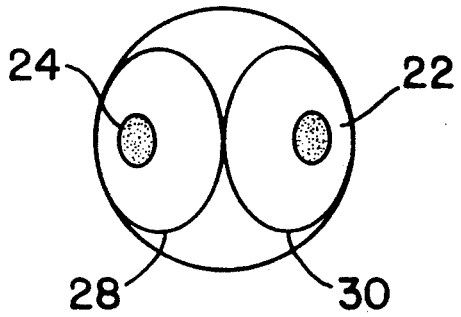
FIG. 7 shows the view of FIG. 5 after rotation of the ball through 45° about the polar axis.

Circle 28 shares a common tangent with circles 29, 30 as is shown in FIG. 7 and each of the circles 27, 28, 29, 30 contacts two neighbouring circles at a common tangent.

Figure 8:
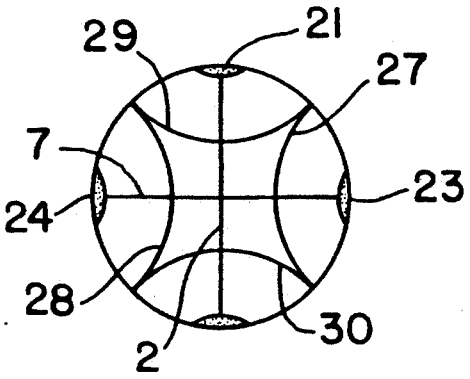
FIG. 8 shows the embodiment of FIG. 5 as viewed in schematic perspective.
Figure 9:
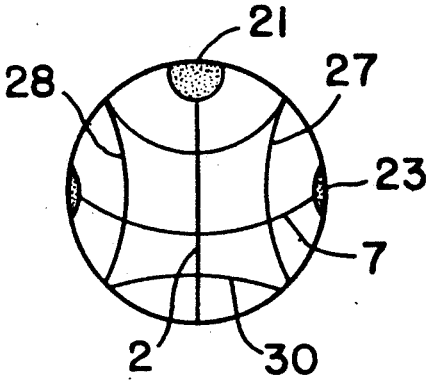
FIG. 9 shows the embodiment of FIG. 8 as viewed in perspective from a slightly different angle.

When viewed from above in plan as in FIG. 5 the ball presents a substantially square projection composed of lines 27, 28, 29, 30 being the upper semicircle of the respective circles. However, when viewed in three dimensional perspective, the appearance is as shown in FIG. 9. In addition the ball of FIGS. 5 to 9 desirably has an equitorial marking 7 and a meridian marking 2 corresponding to those lines similarly identified in the embodiment of FIG. 1.

When a ball according to the present embodiment is placed in a correct position for putting it is orientated as shown in FIG. 5 with meridonal line 2 ("Putter line") aligned with the hole. The player in a correct putting stance has feet together or apart either side of the ball. The stance requires the body to be curved over the ball. Ideally the player's shoulders should be generally square to the ball and parallel to a line from the ball to the hole. Even a slight misalignment of the head produces a markedly different visual impression of the ball as indicated in FIG. 8.

Because of the curvature of the ball even slight rotation of the ball or movement of the player's head brings into view one or other of polar circles 21, 22 or of circles 22, 24.

When in the correct stance the player is given an indication of direction to the hole by the putter line 2 and also of the correct spot at which to hit the ball.

When the ball is putted correctly, polar circles 27, 28 will appear as straight lines to the player as the ball rolls but if mishit the lines appear to wobble giving an indication of the extent and direction of misalignment of the putting stroke.

Figure 10:
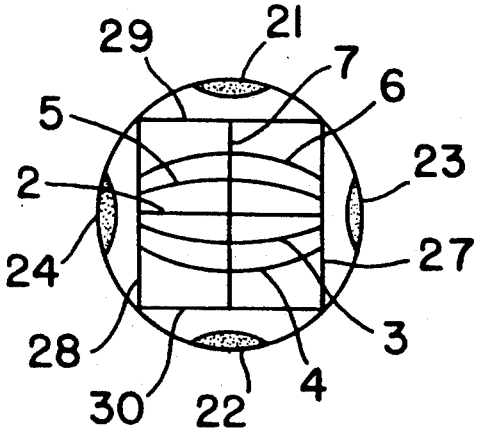
FIGS. 10, 11, 12 show a third embodiment of a ball according to the invention viewed in directions corresponding, respectively, to those of FIGS. 5, 6, 7.
Figure 11:
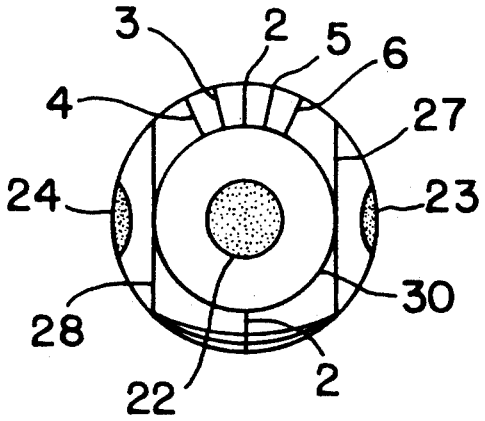
Figure 12:
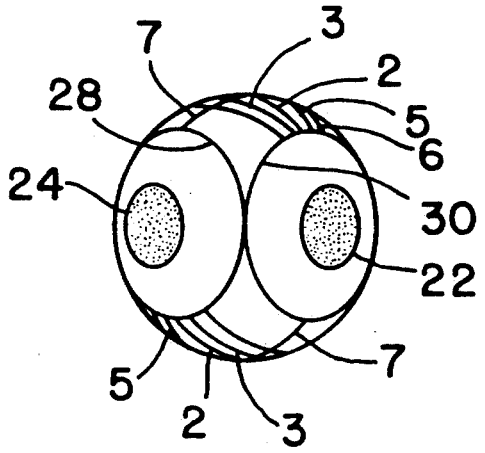

In a preferred embodiment of a golf ball according to the invention, the markings of FIG. 1 are combined with the markings of FIG. 2 as shown in FIGS. 10 to 12 wherein parts and markings corresponding to those of FIGS. 1 to 9 are identified with corresponding numerals.

The embodiment of FIGS. 10 to 12 is used in a similar manner to that of FIG. 1. However, it is Preferably used in the manner previously described wherein the ball is rotated about the polar axis so that wedge line 5 is rotated into a vertical plane for use of a sand wedge or driver line 6 is rotated into the vertical plane for use of a driver. In each case a player in the appropriate address position for use of the corresponding club will see the ball in the view shown in FIG. 10 and take head bearings from putter line 2. Any departure from the correct head position will become apparent to the player by virtue of the features discussed with reference to FIGS. 5–9. This embodiment and method of use has the advantage that the view from a correct stance is the same for each club and the player is provided with an improved reference for determining where the centre of the ball would be.

Meridonal lines 3, 4 symmetrically disposed on the side of line 2 opposite lines 5, 6 are for rotation of the ball in a clockwise direction and facilitate play by left or right handed players.

In more highly preferred embodiments of a ball according to the invention (not illustrated) the ball is marked with a plurality of lines extending at angles of from 13.3° to 25.6° from line 2, for example seventeen lines, each line being centred 0.7° to 0.8° apart (or nine lines each being 1.4 to 1.6 degrees apart) and each being appropriate for use with a club of differing loft from each other.

The seventeen lines may be 0.35° to 0.4° in width, the centre of each line being 0.7° to 0.8° from the next. The lines are preferably of a colour differing from neighbouring lines.

It has been found that for a player having eyes at an altitude of 5 feet 1½ inches with feet a correct distance from the line of play for a wedge club i.e. with toes 1 foot 2½ inches from the ball, the line of sight from the player to the centre of the ball makes an angle of 13.3° with a vertical line through the centre of the ball to play a wedge club. For the same player a correct feet position to play a driver club, with toes 2 feet 5½ 178 inches from the ball, the corresponding angle is at 25.6° to the vertical. Although the player will alter head position in adopting a body stance, the player retains a perception of a frame of reference relative to the ball. Angles for the use of other clubs fall within that range (see Table 1). Although the angle of the sight line for a given club varies according to differing physical build of players, it is a constant for any player and a player will be able to select a marking suitable for use with each of his clubs in the manner herein described.

Further "lines" beyond the "driver line" (25.6° Rotation) may also calculated for example the next line beyond 25.6° rotation would be 26.3°. These extra lines would accommodate a player using longer than normal clubs in the pursuit of gaining more distance from his golf shots.

A player choosing to use a driver of sufficient shaft length to require him to use a line that is 3 lines beyond the "driver line", would, when using a nine iron, choose a line that is 3 lines beyond the 9 iron line; which is, the 6 iron line.

Also, for example, if the same player chose to use a 5 iron; his choice of line would necessarily be a 2 iron line, if all clubs in his set were equally graduated in length.

These further lines would also accommodate the use of a tee; because the ball is higher off the ground when teed-up, a greater degree of rotation is required to place the player the correct distance from the ball for his chosen club.

TABLE 1

| Club | Rotation from "Putter" line |
|---|---|
| Driver | 25.624 |
| 2 wood | 24.91 |
| 3 wood | 24.189 |
| 4 wood | 23.458 |
| 5 wood | 22.721 |
| 6 wood | 21.975 |
| 7 wood | 21.221 |
| 8 wood | 20.459 |
| 1 iron | 19.69 |
| 2 iron | 18.913 |
| 3 iron | 18.129 |
| 4 iron | 17.338 |
| 5 iron | 16.54 |
| 6 iron | 15.736 |
| 7 iron | 14.924 |
| 8 iron | 14.107 |
| 9 iron | 13.284 |
| Wedge | 13.284 |
| Sand wedge | 13.284 |
| Putter | 0° |

With reference to FIGS. 13 and 14 there is shown orientation apparatus 23 according to the invention.

The orientation apparatus comprises a substantially hemispherical hollow cap or shell 24 which is adapted to fit neatly over a golf ball but providing sufficient clearance to permit the ball to be rotated axially while the shell is held stationary.

Shell 24 is integral with a plate mounted latitudinally to its outer circumference. The plate is of elongated pentagonal shape being pointed at one end 30 in direction "Z" and having a square opposite end 29. Tabs 26 extending laterally of the plate adjacent shell 24 permit the apparatus to be lifted from a golf ball without disturbing the ball or permit the apparatus to be steadied while a ball is rotated therebeneath. A slot shaped window 25 extends circumferentially of shell 24 and is in alignment with direction "Z". A spirit level 27 is provided adjacent end 29. The orientation apparatus may be made from any suitable material, for example plastics.

In use, the orientation apparatus is placed upon a ball according to the invention e.g. a ball such as shown in FIG. 1 or FIG. 5 so that cap 24 fits snugly over the ball (indicated in broken line in FIG. 13). The ball may be on a tee or on turf, or other surface. Window 25 and pointer 30 are aligned with the intended direction of play and the apparatus is levelled by means of spirit level 27. When the apparatus is oriented in the manner described it provides a frame of reference for the ball, the window slot defining a vertical plane extending through the centre of the ball.

Holding the orientation apparatus steady, the ball is then reoriented by rotation relative to the apparatus. A line marked on the ball appropriate to a club intended to be used, for example line 5 for use of a wedge, is brought into view in window slot 25 and aligned with the slot. In this manner the ball is orientated so that line 5 is in a vertical plane and so that line 5 is aligned with the intended direction of play.

The orientation device may then be lifted gently from the ball without changing the balls orientation or lie, and line 2 used as a bearing to guide the player in adopting a correct address stance. The player in correct stance will see the ball as indicated in FIG. 10.

It will be understood that apparatus according to the invention need not have a shell and less preferred embodiments could use for example a tripod arrangement or merely a circular hole of suitable diameter in plate 33. Tabs 26 are optional. While a window slot is preferred the device could be made from a transparent plastic and use a line marking in place of the slot or could utilize other means for sighting on a direction of play and identifying a vertical plane. Furthermore, if preferred, the device could utilize a marking on the ball adapted to orientate the ball with reference to a horizontal plane rather than to a vertical plane or could use a plumb line or other means to establish a vertical plane. The invention hereof extends to include such apparatus adapted for orientation of a golf ball within its scope.

If preferred the orientation apparatus may be provided with a plurality of slots or markings corresponding to angles to the vertical shown in Table 1 and these may be used to rotate the putter line of a golf ball to an appropriate angle for a given club. In that case the golf ball need have only one meridonal line.

As will be apparent to those skilled in golf from the teaching hereof the invention gives a golfer a visual indication of his address position in relation to the intended line of movement of the ball, of distance from the ball, of correct posture, and of correct club angle square to the target line and gives perceivable indications of a direction of error from the correct position. The ball provides a frame of reference for establishing correct stance for uphill or downhill lie, side hill lie, fade shots, draw shots, slice shots and hook shots and indicates a correct putting stroke through the ball. It also gives indication of excessive head swing.

FIGS. 15, 16, 17, 18, 19 and 20 show schematically less preferred embodiments of balls according to the invention which may be used in a similar manner to or have features which may be combined with, those of balls described above.

It will be appreciated that locations on the surface of a ball may be marked by means other than a printed line for example by a row of dots, a line reversed out of a printed area, indentations, graduations or the like.

I claim:

1. An orientation apparatus comprising a device adapted for placement on a golf ball, said device defining a reference plane and having a window permitting a marking on the ball to be viewed and to be aligned relative to the reference plane, said device being provided with a directional indicator for alignment of said marking on the ball with an intended direction of play, said window including a plurality of lines each extending in a meridional direction relative to said reference plane, said lines being spaced apart in the equatorial direction and each providing a line-of-sight bearing for a player using a respective selected club from a set in relation to which to adjust his stance, and said device including a cap which fits neatly on the ball and permits the ball to be oriented by rotation while the device is held stationary.

2. An apparatus according to claim 1 wherein the device incorporates a spirit level.

3. An apparatus according to claim 1, wherein the defined reference plane is vertical.

4. An apparatus according to claim 1 wherein said lines are marked on a transparent window.

5. An apparatus according to claim 1 wherein said lines are of a color each different from the other.

6. An apparatus according to claim 1 wherein said lines are selected to be spaced at angles of between 13.3° to 25.6° from said reference plane.

7. In combination, an orientation apparatus comprising a device adapted for placement on a golf ball, said device defining a reference plane and having a window permitting a marking on the ball to be viewed and to be aligned relative to the reference plane, said device being provided with a directional indicator for alignment of said marking on the ball with an intended direction of play, and a golf ball having a plurality of markings on its surface which are visible to a player addressing the ball, the markings defining a plurality of lines each extending in a meridional direction, the lines being spaced apart in the equatorial direction and each providing a line-of-sight bearing for a player using a respective club from a set in relation to which to adjust his stance.

8. A combination according to claim 7, wherein the markings are lines of color each different from the other.

9. A combination in accordance with claim 7, wherein the meridional lines are selected to be spaced at angles of between 13.3° to 25.6° from the reference line.

10. A combination according to claim 7 adapted to facilitate orientation of a golf ball so that one of the meridional lines is in a reference plane, and is aligned with an intended direction of play.

* * * * *